US007516643B2

(12) United States Patent
Valentini

(10) Patent No.: US 7,516,643 B2
(45) Date of Patent: Apr. 14, 2009

(54) IMPACT IDENTIFICATION SENSOR

(76) Inventor: Stefano Valentini, Via Pedemonte 2, Lugano-Viganello (CH) 6962

( * ) Notice: Subject to any disclaimer, the term of this patent is extended or adjusted under 35 U.S.C. 154(b) by 4 days.

(21) Appl. No.: 11/667,022

(22) PCT Filed: Oct. 27, 2005

(86) PCT No.: PCT/IB2005/003285

§ 371 (c)(1),
(2), (4) Date: May 4, 2007

(87) PCT Pub. No.: WO2006/048739

PCT Pub. Date: May 11, 2006

(65) Prior Publication Data

US 2008/0009245 A1 Jan. 10, 2008

(30) Foreign Application Priority Data

Nov. 5, 2004 (CH) ..... 1825/04

(51) Int. Cl.
*G01M 7/00* (2006.01)

(52) U.S. Cl. ..... 73/12.01; 73/12.09

(58) Field of Classification Search ..... 73/12.01–12.14
See application file for complete search history.

(56) References Cited

U.S. PATENT DOCUMENTS

| | | | | |
|---|---|---|---|---|
| 4,487,583 | A | 12/1984 | Brucker et al. | |
| 4,898,388 | A * | 2/1990 | Beard et al. | 473/192 |
| 5,195,752 | A * | 3/1993 | Reeves et al. | 273/374 |
| 5,354,057 | A | 10/1994 | Pruitt et al. | |
| 5,788,500 | A | 8/1998 | Gerber et al. | |
| 5,947,738 | A | 9/1999 | Muehle et al. | |
| 6,925,851 | B2 * | 8/2005 | Reinbold et al. | 73/12.09 |
| 7,107,839 | B1 * | 9/2006 | Berman et al. | 73/489 |
| 2007/0089480 | A1 * | 4/2007 | Beck | 73/12.01 |

FOREIGN PATENT DOCUMENTS

WO 99/10700 3/1999

* cited by examiner

*Primary Examiner*—Max Noori
(74) *Attorney, Agent, or Firm*—Young & Thompson

(57) ABSTRACT

A sensor is able to perform identification of an impact acting on a support and resonance plate (2) and send a signal to a measuring and recording station (4). The sensor (1) is provided with an intermediate apparatus (3) which, after analyzing the characteristics of the effects produced by the impact and comparing them with the characteristics produced by the impact of a non-lethal projectile, sends the signal to the measuring and recording station (4) only in the case where these characteristics coincide substantially.

14 Claims, 1 Drawing Sheet

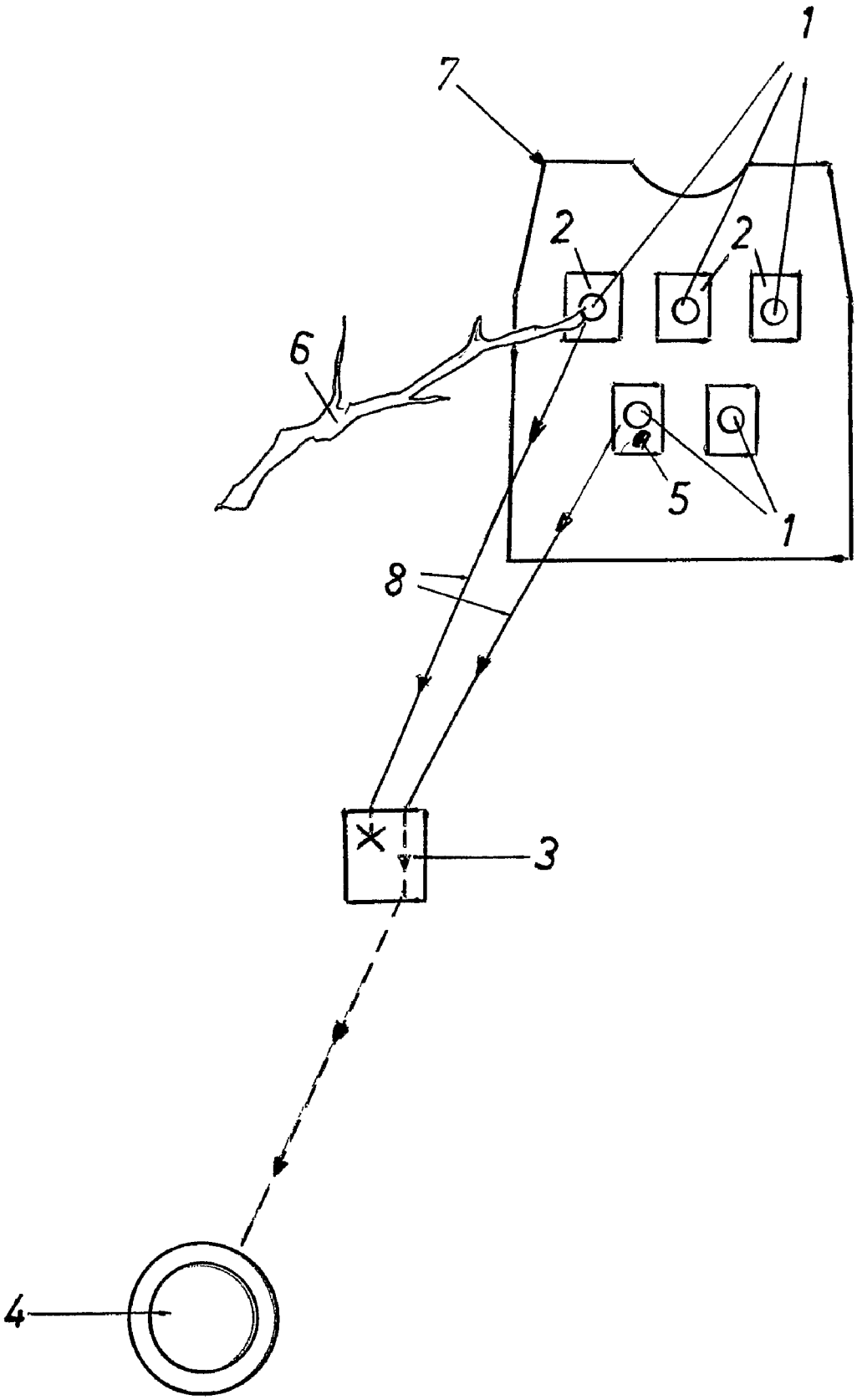
1
7
2
2
6
5
1
8
3
4

IMPACT IDENTIFICATION SENSOR

BACKGROUND OF THE INVENTION

1. Field of the Invention

The present invention relates to the sector of military and law enforcement training systems involving simulated combats during which non-lethal projectiles are fired. These systems are composed of several impact sensors which are distributed over the body of the combatants, being fixed onto special clothing (protective vests, jackets and the like). These sensors are usually mounted on larger-size support bases and detect the effects produced by the impact of a non-lethal projectile on them, sending subsequently a signal to a measuring and recording receiver station which has the function of monitoring and checking the progress of the simulated combats.

2. Description of the Related Art

Such a type of system and the various components which form the system are, for example, described in patent application PCT/IB04/001529 in the name of the same Applicant.

The effectiveness of these systems and the reliability of the recordings made by the already mentioned receiver station (generally consisting of a suitably programmed computer) during the course of a simulated combat, however, are frequently hampered by the fact that the sensors are struck not only by the non-lethal projectiles but also by foreign bodies (branches, fixed obstacles, etc.) and in this case emit a signal which, being sent to the receiver station, creates confusion as to the actual progress of the combat, which is difficult to eliminate. The inventor of the subject of the present application has come up with the idea that, in order to overcome this major drawback, it would be possible to provide each sensor with the capacity to identify clearly the effects of the shock wave produced by the impact of a non-lethal projectile, so as to be able to distinguish them accurately and reliably from those produced by accidental events and send only the relevant signals to the receiver station.

SUMMARY OF THE INVENTION

The inventor has therefore devised the sensor according to the present invention, which is provided with an intermediate apparatus which acts as a "filter" for the signals which it sends and which, after comparing their characteristics with the corresponding ones produced by the impact of a non-lethal projectile, forward them to the receiver station only if these characteristics substantially coincide.

The abovementioned intermediate apparatus may advantageously be designed so that it comprises special software equipped with a memory in which the characteristics of the non-lethal projectile impacts are recorded and with a program able to compare them with those of the impact acting on the sensor and enable sending of a signal to the receiver station only in the cases where, as mentioned, these characteristics substantially coincide.

The sensor according to the invention is thus equipped with an intermediate "filter" which reliably prevents it from sending directly to the receiver station unrelated signals which must not be taken into consideration when evaluating the progress of a simulated combat.

It is obvious that the sensor is able to transmit to the intermediate apparatus the characteristics produced on it by an impact in analogue, analogue/digital or digital form, by means of wiring or radio waves.

It should also be noted that, depending on its structure and the software program with which it is equipped, a same intermediate apparatus may also be used for several sensors. Said apparatus may be housed inside a small anti-impact container which is situated inside a pocket of one of the clothes worn by a combatant and may obviously be connected only to the sensors which are fixed onto the body of this combatant.

The object of the present invention is therefore to provide a sensor as described in the accompanying claim 1.

BRIEF DESCRIPTION OF THE DRAWING FIGURE

A preferred example of embodiment of a sensor according to the invention will now be described in more detail, with reference also to the accompanying figure which is a block diagram illustrating operation thereof in the case of a wire connection between one or more sensors and the abovementioned intermediate apparatus.

DETAILED DESCRIPTION OF THE PREFERRED EMBODIMENT

As can be seen in the drawing, several sensors 1 according to the invention are mounted on support and resonance plates 2 of the known type fixed onto a vest 7 and are connected by means of wiring 8 to a single intermediate apparatus 3 which, owing to the suitably programmed software already described above, receives from the sensors 1 the characteristics produced by all the impacts acting on the support and resonance plates 2.

After analyzing and comparing them with those which are produced by the impact of a non-lethal projectile and stored in its memory, the said intermediate apparatus 3 sends a signal to the receiver station 4 only when these characteristics substantially coincide with those of an impact of a non-lethal projectile 5, but does not send any signal to the receiver station 4 when these characteristics are of a different nature (for example produced by the impact against a branch 6).

With the use of one or more sensors designed in accordance with the invention, the predefined object of the inventor is achieved, namely that of ensuring accurate and reliable monitoring of a simulated combat by a measuring and recording station.

In the accompanying drawing both the intermediate apparatus 3 and the measuring and recording station 4 have been shown in schematic form, in view off the numerous embodiments from among which a person skilled in the art can easily choose.

The invention claimed is:

1. A sensor for simulated combat (1) able to perform identification of an impact acting on at least one support and resonance plate (2) and send a signal to a measuring and recording station (4), said sensor (1) being provided with an intermediate apparatus (3) wherein said intermediate apparatus (3) after analyzing characteristics of effects produced by the impact and comparing the characteristic of the effects with characteristics produced by a recorded impact of a non-lethal projectile fired from a gun, sends the signal to the measuring and recording station (4) only in a case where the characteristics coincide substantially, wherein the intermediate apparatus (3) is housed inside an anti-impact container.

2. The sensor for simulated combat according to claim 1, wherein the sensor transmits the characteristics of the effects produced by the impact by means of wiring (8) which connects the sensor to the intermediate apparatus (3).

3. The sensor for simulated combat according to claim 1, wherein the sensor transmits the characteristics of the effects produced by the impact to the intermediate apparatus (3) in the form of radio signals.

4. The sensor for simulated combat according to claim 1, wherein the anti-impact container is situated inside a pocket.

5. The sensor for simulated combat according to claim 4, wherein the pocket is on clothes worn by a combatant.

6. The sensor for simulated combat according to claim 2, wherein the anti-impact container is situated inside a pocket.

7. The sensor for simulated combat according to claim 6, wherein the pocket is on clothes worn by a combatant.

8. The sensor for simulated combat according to claim 3, wherein the anti-impact container is situated inside a pocket.

9. The sensor for simulated combat according to claim 8, wherein the pocket is on clothes worn by a combatant.

10. A sensing system for simulated combat, comprising:

at least one support and resonance plate (2);

a measuring and recording station (4);

a sensor (1) adapted to identify an impact on the support and resonance plate (2) and to send a signal to the measuring and recording station (4);

an intermediate apparatus (3); and an anti-impact container in which the intermediate apparatus is housed, wherein said intermediate apparatus (3) after analyzing characteristics of effects produced by the impact and comparing the characteristic of the effects with characteristics produced by a recorded impact of a non-lethal projectile fired from a gun, sends the signal to the measuring and recording station (4) only in a case where the characteristics coincide substantially.

11. The sensing system for simulated combat according to claim 10, wherein the sensor transmits the characteristics of the effects p educed by the impact by means of wiring (8) which connects the sensor to the intermediate apparatus (3).

12. The sensing system for simulated combat according to claim 10, wherein the sensor transmits the characteristics of the effects produced by the impact to the intermediate apparatus (3) in the form of radio signals.

13. The sensing system for simulated combat according to claim 10, wherein the anti-impact container is situated inside a pocket.

14. The sensor for simulated combat according to claim 13, wherein the pocket is on clothes worn by a combatant.

* * * * *